US005120040A

United States Patent [19]

Worley

[11] Patent Number: 5,120,040

[45] Date of Patent: Jun. 9, 1992

[54] SHEET MEDIA TRAY AND MECHANISM FOR FEEDING MEDIA OF TWO DIFFERENT SIZES

[75] Inventor: A. Justine Worley, Chino Hills, Calif.

[73] Assignee: Dataproducts, Woodland Hills, Calif.

[21] Appl. No.: 759,699

[22] Filed: Sep. 10, 1991

Related U.S. Application Data

[63] Continuation of Ser. No. 433,932, Nov. 9, 1989, abandoned.

[51] Int. Cl.[5] ..... B65H 3/44

[52] U.S. Cl. ..... 271/9; 271/119; 271/127; 271/160; 271/167; 271/171

[58] Field of Search ..... 271/9, 119, 121, 126, 271/127, 160, 167, 169, 170, 171

[56] References Cited

U.S. PATENT DOCUMENTS

| | | | |
|---|---|---|---|
| 3,383,105 | 5/1968 | Roberts . | |
| 4,101,018 | 7/1978 | Sokolowski . | |
| 4,255,064 | 3/1981 | Kelly . | |
| 4,265,556 | 5/1981 | Krieg et al. . | |
| 4,303,235 | 12/1981 | Calebrese | 271/162 |
| 4,348,125 | 9/1982 | Fujiwara et al. . | |
| 4,363,477 | 12/1982 | Riyashita | 271/170 X |
| 4,364,683 | 12/1982 | Shakib et al. . | |
| 4,416,559 | 11/1983 | Steinhilber . | |
| 4,429,863 | 2/1984 | Itoh et al. | 271/9 |
| 4,449,705 | 5/1984 | Shibuya et al. | 271/164 |
| 4,583,873 | 4/1986 | Parks et al. | 271/170 X |
| 4,585,224 | 4/1986 | Kuzuya . | |
| 4,602,750 | 7/1986 | Hjortnas . | |
| 4,606,663 | 8/1986 | Christoph et al. . | |
| 4,647,265 | 3/1987 | Uno . | |
| 4,655,626 | 4/1987 | Okazaki . | |
| 4,664,544 | 5/1987 | Miyako et al. . | |
| 4,674,899 | 6/1987 | Kimura . | |
| 4,693,620 | 9/1987 | Harumatsu . | |
| 4,896,871 | 1/1990 | Idenawa | 271/9 |

FOREIGN PATENT DOCUMENTS

| | | | |
|---|---|---|---|
| 3608273 | 9/1987 | Fed. Rep. of Germany | 271/9 |
| 3707868 | 9/1987 | Fed. Rep. of Germany | 271/9 |
| 69647 | 4/1983 | Japan | 271/9 |
| 139935 | 8/1983 | Japan | 271/126 |
| 128142 | 7/1984 | Japan | 271/9 |
| 61428 | 4/1985 | Japan | 271/9 |
| 97133 | 5/1985 | Japan | 271/162 |
| 228341 | 11/1985 | Japan | 271/169 |
| 124449 | 6/1986 | Japan | 271/9 |
| 174043 | 8/1986 | Japan | 271/9 |
| 188335 | 8/1986 | Japan | 271/9 |
| 211250 | 9/1987 | Japan | 271/9 |
| 34820 | 2/1989 | Japan | 271/121 |
| 104537 | 4/1989 | Japan | 271/121 |

OTHER PUBLICATIONS

Brown, "Dual Paper Cassettes with Common Feed Mechanism", Dec. 1980, IBM Technical Bulletin, vol. 23, No. 7A, p. 2683.

Adams, "Taper Feed System", Mar. 1982, IBM Technical Disclosure Bulletin, vol. 24, No. 10, p. 5028.

*Primary Examiner*—D. Glenn Dayoan
*Assistant Examiner*—Boris Milef
*Attorney, Agent, or Firm*—Spensley, Horn, Jubas & Lubitz

[57] ABSTRACT

A sheet media feed mechanism including a sheet media tray, the sheet media tray having a lower tray for holding a stack of automatic-feed cut sheet media and an upper tray for holding individual sheets of manual-feed sheet media. The lower tray has a pair of corner-pick separators for separating the top sheet of sheet media from the stack. The upper tray has a frame positioned over a rear portion of the lower tray leaving a front portion of the lower tray exposed, and pair of flexible sidekicks extending out over the exposed portion and having a sheet media separator at the front tips of the sidekicks. A pair of D-rollers mounted on a shaft pick the top sheet of sheet media from the lower tray when no sheet media is present at the upper tray, the D-rollers also adapted to pick the top sheet of sheet media from the upper tray when at least one sheet of sheet media is present thereat. The picked sheet media is then fed to a feed path.

22 Claims, 5 Drawing Sheets

SHEET MEDIA TRAY AND MECHANISM FOR FEEDING MEDIA OF TWO DIFFERENT SIZES

This is a continuation of application Ser. No. 07/433,932 filed on Nov. 9, 1989, now abandoned.

BACKGROUND OF THE INVENTION

1. Field of the Invention

The present invention relates to a sheet media feed mechanism and in particular to a sheet media tray which allows sheet media from two separate locations to be picked by the same pick mechanism and fed to the same feed path.

2. Description of the Prior Art

The prior art devices will be discussed in terms of printers, although the concepts may be equally applicable to other devices having cut sheet media feed mechanisms; such as copiers.

In printers wherein cut sheet media is printed, there is a need to feed two types of cut sheet media from two different sources. The two types of sheet media to be fed are usually loaded into and held by separate compartments. The first type of cut sheet media is usually of a predetermined size and is fed automatically, without any operator intervention, from a stack of cut sheet media held in a tray. The second type of cut sheet media may be fed manually by an operator, and may come in different sizes, such as letterheads, cards and forms, for example.

To feed two types of sheet media from two different sources or locations, prior art sheet media feeding mechanisms have employed separate pick mechanisms for picking the sheet media from separate locations or separate feed paths for feeding sheet media from separate sources. Sometimes, both separate pick mechanisms and separate feed paths are used. Separate pick mechanisms and separate feed paths are generally used because the tray for either the manual feed sheet media or the automatic feed sheet media usually obstructs the sheet media from being picked or fed from the other tray. Separate pick mechanisms and separate feed paths result in increased costs and complexity.

Thus, it is desirious to cut costs and decrease the complexity of the sheet media feed mechanism by providing a sheet media feed mechanism which allows manual feed sheet media and automatic feed sheet media to be picked by the same pick mechanism and to be fed to the same feed path.

SUMMARY OF THE INVENTION

Accordingly, it is an object of this invention to provide a simple and inexpensive sheet media feed mechanism which allows manual feed sheet media and automatic feed sheet media to be picked by the same pick mechanism and to be fed to the same feed path.

It is another object of this invention to provide a sheet media compartment having an upper compartment for holding manual feed sheet media and a lower compartment for holding automatic feed sheet media so that the upper compartment does not obstruct automatic feed sheet media from the lower compartment from being picked and fed.

It is another object of this invention to provide a sheet media compartment having an upper compartment for holding manual feed sheet media of varying widths and a lower compartment for holding automatic feed sheet media wherein only one sheet of sheet media is fed from either compartment at a time.

A sheet media feed mechanism according to this invention for feeding sheet media from separate compartments to one feed path comprises a lower compartment for holding a stack of sheet media and having separators for ensuring that only one sheet of sheet media is picked from the lower compartment, an upper compartment for holding individual sheets of manually inserted sheet media and having two flexible sidekicks with separators for ensuring that only one sheet of sheet media is picked from the upper compartment, and a motor driving a shaft having two D-rollers for applying pressure to the top sheet of sheet media to pick the top sheet of sheet media to be fed to the one feed path.

BRIEF DESCRIPTION OF THE DRAWINGS

The invention will be described in connection with one embodiment thereof with reference to the accompanying drawings.

DESCRIPTION OF THE PREFERRED EMBODIMENT

The preferred embodiment will be described with reference to FIGS. 1 to 6.

Figure 1:
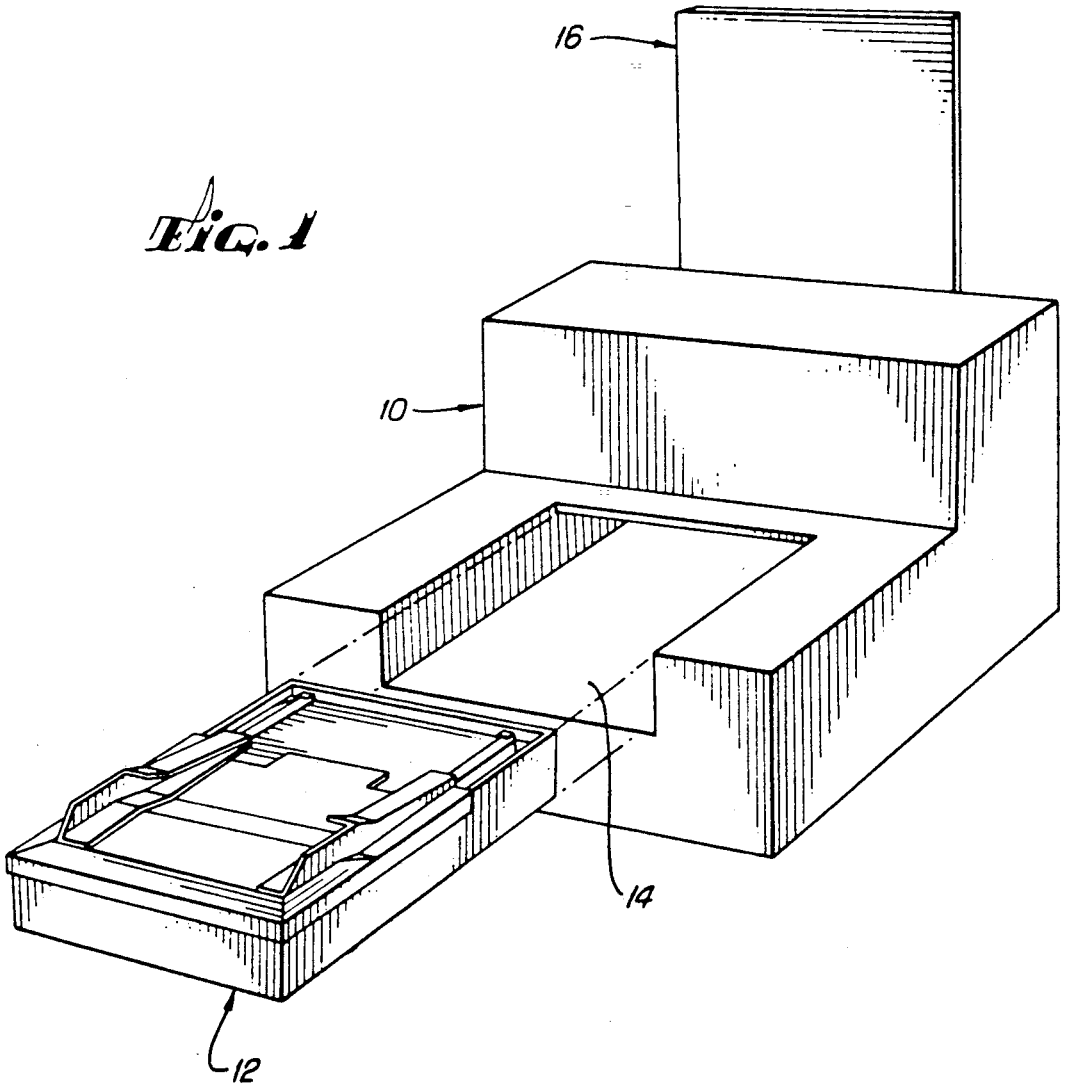
FIG. 1 is an overall view showing a printer with the sheet media feed mechanism of the invention.

In FIG. 1, a printer 10 for printing cut sheet media has an opening 14 wherein a sheet media tray 12 may be inserted. The opening 14 has guides (not shown) on which the sheet media tray 12 may be slidably inserted, and an automatic latch (not shown). The guides provide the support and positioning necessary for the sheet media tray 12 to properly deliver the sheet media to the sheet media transport mechanism. The automatic latch holds the tray 12 in place during delivery of the sheet media, but will release the tray 12 for removal so that the operator can reload the sheet media.

The sheet media feed mechanism, which will be described more fully below, feeds sheet media from the sheet media tray 12 to the sheet media transport mechanism within the printer 10. The printer 10 may be any conventional impact or non-impact printer. The sheet media transport mechanism delivers the cut sheet media to the printing area where a print head prints the desired image onto the sheet media. The sheet media is then fed to an output tray 16 where the operator can pick it up.

The preferred embodiment and the operation of the sheet media feed mechanism will be more fully explained with reference to FIGS. 2–6.

The sheet media tray comprises a lower tray 20 for holding a stack of cut sheet media and an upper tray 22, which acts as a lid for the lower tray 20, for holding individual sheets of sheet media.

Figure 2:
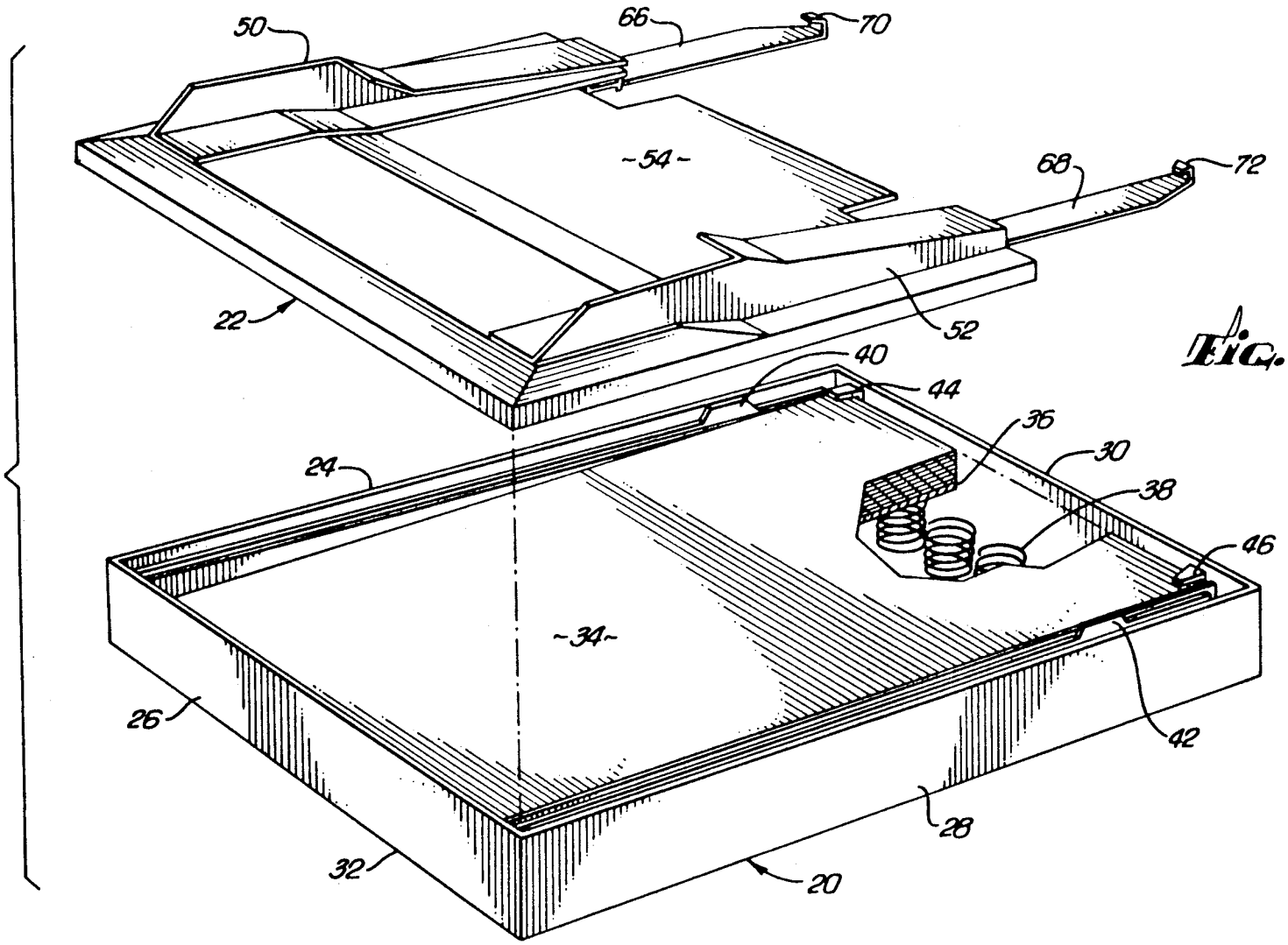
FIG. 2 is an exploded righthand side view of the sheet media tray showing the upper and the lower trays.
Figure 3:
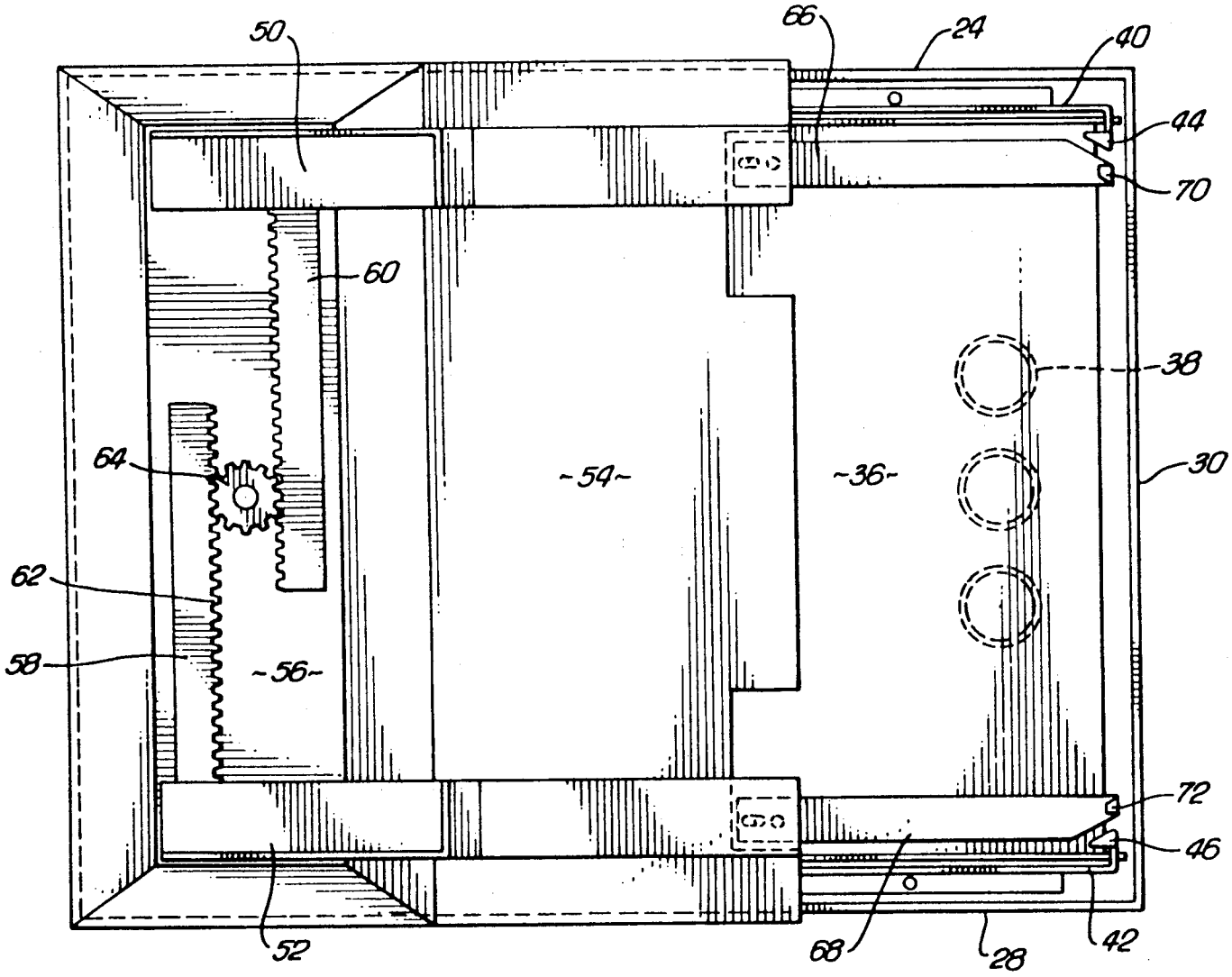
FIG. 3 is a top plan view of the sheet media tray.

Referring to FIGS. 2–3, the sheet media tray 12 comprises a lower tray 20 for holding and automatically delivering a stack of pre-loaded cut sheet media 34 to the printer 10. This stack of sheet media 34 is automatically fed to the printer 10 without any operator intervention, and is therefore called automatic feed sheet media. The sheet media tray 12 also comprises an upper tray 22 for holding and delivering individual sheets of cut sheet media. These sheets of sheet media, which can be of varying sizes, are manually fed by an operator and are therefore called manual feed sheet media. When sheet media is present at the upper tray 22, the sheet media feed mechanism will always pick the top sheet of sheet media from the upper tray 22. The top sheet from the lower tray 20 is picked only if there is no sheet media at the upper tray 22.

The lower tray 20 comprises four walls 24, 26, 28, 30 and a base plate 32. The lower tray 20 illustratively holds a stack of 250 sheets of cut sheet media 34 to allow a reasonable amount of printing before the lower tray 20 needs to be reloaded. The stack of cut sheet media 34 is supportably held by a hinged support plate 36, which is mounted on the base plate 32 by means of an elevating mechanism 38, which may be a resilient spring. The resiliency of the elevating mechanism 38 forces the support plate 36 and the stack of sheet media 34 thereon vertically upwards.

The lower tray 20 also has a pair of opposite elongated metal mounts 40 and 42 along the edges of the opposing walls 24 and 28 respectively (see FIG. 3). The mount 40 has a hook-shaped corner-pick separator 44 fixedly protruding from its extreme end near the corner adjacent the walls 24 and 30 (see FIGS. 2-3). The mount 42 has a mirror-imaged corner-pick separator 46 near the corner adjacent the walls 28 and 30. The two corner-pick separators 44 and 46 are thus disposed at the two corners of the leading edge of the top sheet of sheet media in the stack 34 positioned within the lower tray 20.

Thus, the stack of sheet media 34 is firmly positioned by the support plate 36 and the corner-pick separators 44 and 46. The resiliency of the elevating mechanism 38 forces the support plate 36 and the stack of sheet media 34 thereon vertically upwards, while the corner-pick separators 44 and 46 hold the leading corners of the top sheet of sheet media in the stack 34 so as to prevent the stack 34 from extending past the fixed vertical common reference point defined by the corner-pick separators 44 and 46.

The upper tray 22 forms a lid or cover for the lower tray 20. The upper tray 22 comprises a frame 54 which covers a portion of the lower tray 20, exposing an open portion of the lower tray 20 defined by a portion of the walls 24 and 28 and the wall 30. The upper tray 22 comprises an opposite pair of slidably adjustable sheet media width guides 50 and 52 disposed above the frame 54. The guides 50 and 52 are mounted to racks 60 and 58, respectively, through an opening 56 in the frame 54. Thus, the racks 58 and 60 are disposed beneath the frame 54. The racks 58 and 60 have teeth 62 fitted for engagement with the teeth on a gear 64. For example, when the guide 50 is slid inwards or outwards, the teeth 62 on the rack 60 associated with the guide 50 engages the teeth on the gear 64, causing the gear 64 to rotate. The teeth of the rotating gear 64 engages the teeth 62 of the other rack 58, causing the other guide 52 to slidably adjust by the same amount as the guide 50. Thus, the guides 50 and 52 may be slidably adjusted in equal amounts for varying widths of manual-feed sheet media.

The guides 50 and 52 each have an elongated sidekick 66 and 68, respectively, extending therefrom. The sidekicks 66 and 68 are made from the flexible material mylar and may be flexed upwards. Each sidekick 66 and 68 has a hook-shaped sidekick separator 70 and 72 respectively. The sidekicks 66 and 68 supportably hold and position manual feed sheet media, with the sidekick separators 70 and 72 disposed at the leading corners of a sheet of manual feed sheet media and defining the extent to which the sheet media may be inserted. When manual feed sheet media is so inserted, the manual feed sheet media covers the open portion of the lower tray 20 and upper tray 22. The sidekicks 66 and 68, which are mounted to the adjustable guides 50 and 52, respectively, are adjusted in unison with the guides 50 and 52 to accommodate manual feed sheet media of varying widths.

Figure 4:
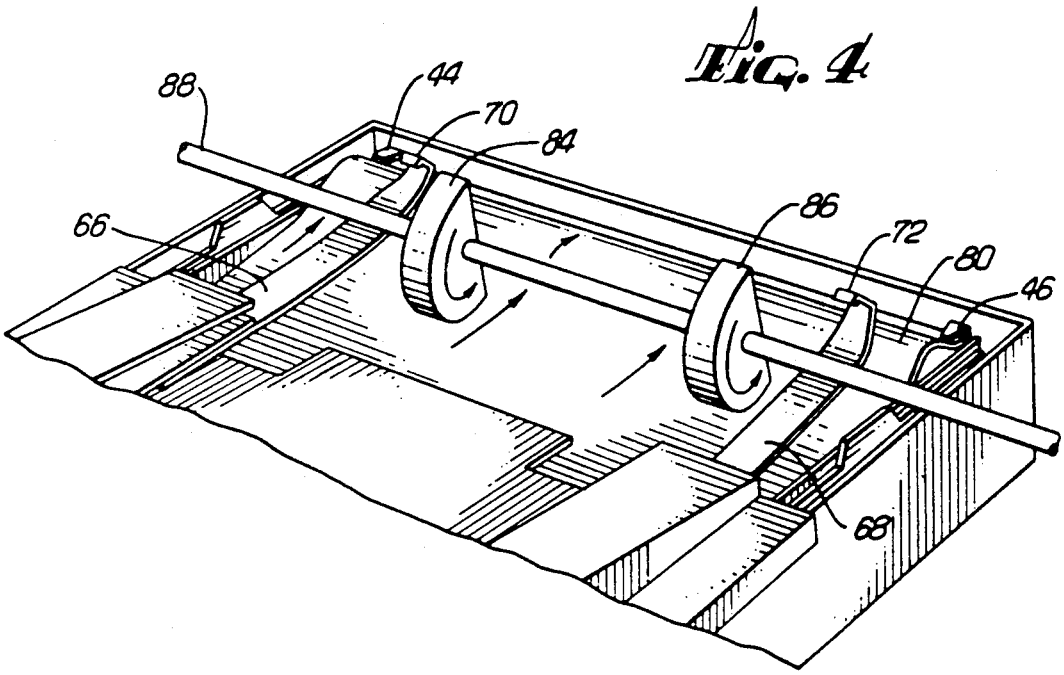
FIG. 4 is a righthand side view of the sheet media tray illustrating the picking of a sheet of automatic feed sheet media from the lower tray.
Figure 5:
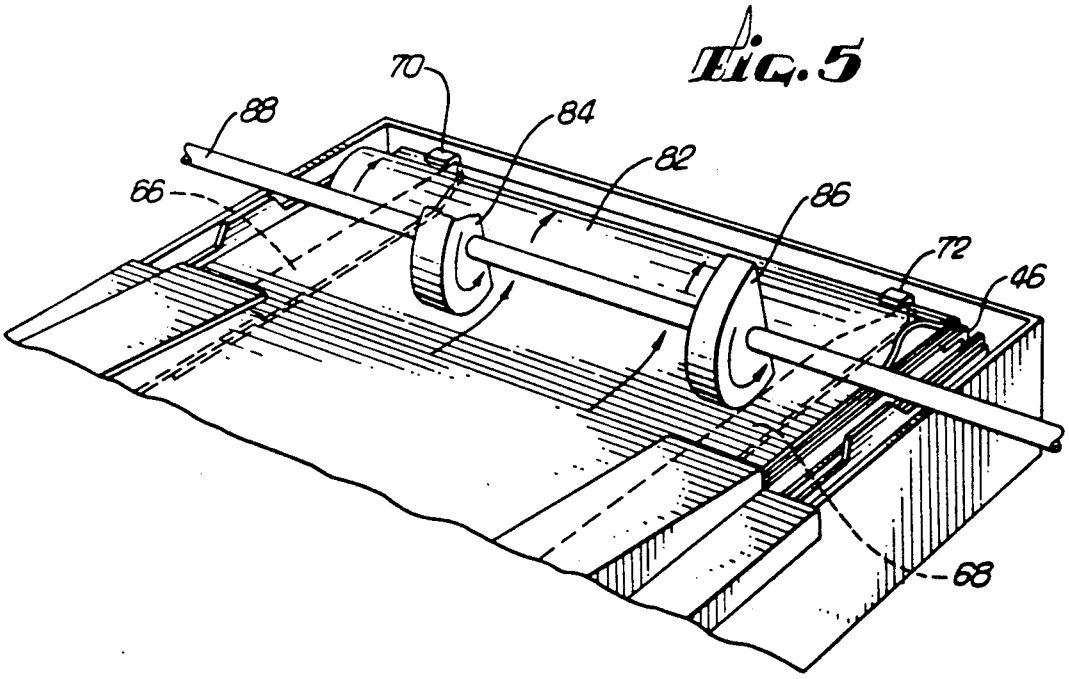
FIG. 5 is a righthand side view of the sheet media tray illustrating the picking of a sheet of manual feed sheet media from the upper tray.
Figure 6:
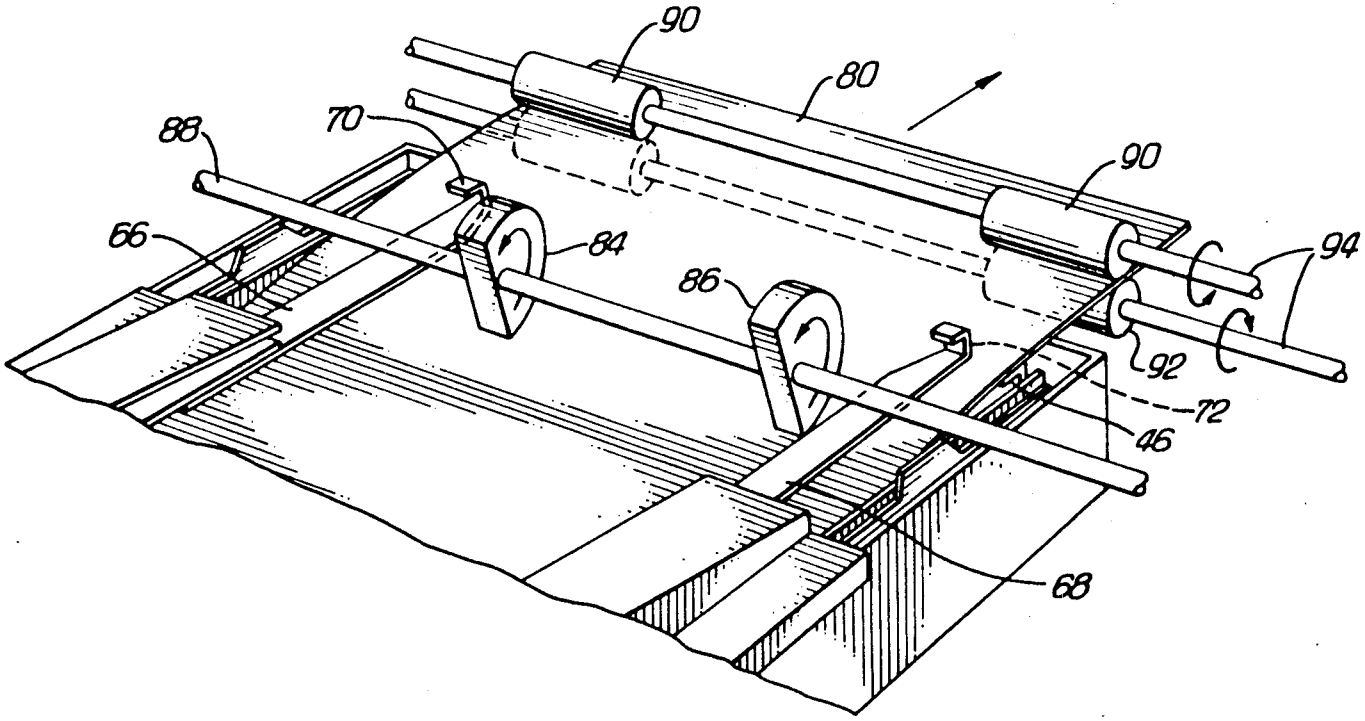
FIG. 6 is a righthand side view of the sheet media tray and the feed path illustrating the feeding of a sheet of automatic feed sheet media to the feed path.

The operation of the sheet media feed mechanism will now be described with reference to FIGS. 4-6. The feeding of the top sheet of automatic feed sheet media 80 from the lower tray 20 to the printer !0 for printing, where there is no manual feed sheet media in the upper tray 22, is shown in FIG. 4. The feeding of the top sheet of manual feed sheet media 82 from the upper tray 22 to the printer 10 even where there is a stack of automatic feed sheet media in the lower tray 20 is shown in FIG. 5. The feeding of a sheet of automatic feed sheet media to the feed path is shown in FIG. 6. It should be noted that automatic feed sheet media may only be fed if no manual feed sheet media is present in the upper tray 22.

Referring to FIG. 4, the lower tray 20 holds a stack of automatic feed sheet media, while the upper tray 22 does not hold any manual feed sheet media. When it is desirious to pick the top sheet of automatic feed sheet media 80, a motor (not shown) rotates a shaft 88 causing a pair of "D"-shaped rollers 84 and 86, which are fitted on the shaft 88, to rotate. The shaft 88 and the D-rollers 84 and 86 are disposed above the open portion of the lower tray 20. The rotating D-rollers 84 and 86 push the top sheet of automatic feed sheet media 80 against the corner-pick separators 44 and 46 in the direction indicated by the arrows in FIG. 4, causing the top sheet of automatic feed sheet media 80 to buckle As the D-rollers 84 and 86 push the buckled top sheet 80 further against the corner-pick separators 44 and 46, the top sheet 80 eventually comes free from the corner-pick separators 44 and 46. It is important to note that the freed top sheet 80 is not obstructed by the sidekicks 66 and 68 because they flex upwards to accommodate the upward displacement of the top sheet 80. Further rotation of the D-rollers 84 and 86 will advance the freed top sheet of automatic feed sheet media 80 to a feed path in the opening 14 comprising two sets of pinch rollers 90 and 92, which are mounted on idle shafts 94 (see FIG. 6). The sheet media 80 is gripped by the pinch rollers 90 and 92 and advanced to the printing area for printing. Alternatively, the feed path may comprise rollers mounted on an idle shaft and a platen, with the rollers and the platen gripping the sheet media and advancing it through the printing area.

Referring now to FIG. 5, the lower tray 20 holds a stack of automatic feed sheet media, while the upper tray 22 and its sidekicks 66 and 68 hold sheets of manual feed sheet media or other media such as transparency media 82 so that the manual feed sheet media 82 covers the open portion of the lower tray 20. When it is desirious to pick the top sheet of manual feed sheet media 82, the same D-rollers 84 and 86 are rotated by the motor to push the top sheet of manual feed sheet media 82 against the sidekick separators 70 and 72 to cause the top sheet of manual feed sheet media 82 to buckle and ultimately come free. Further rotation of the D-rollers 84 and 86 will advance the freed top sheet of manual feed sheet media 82 to the same feed path where it is taken by the two sets of pinch rollers 90 and 92.

Thus, it can be seen that the separators 44, 46, 70 and 72 serve the further purpose of ensuring that only the top sheet from either tray is picked at a time. When the D-rollers 84 and 86 push the top sheet and cause it to buckle, only the top sheet will come free from the separators.

Thus, the invention uses the same sheet media pick mechanism, the D-rollers 84 and 86, to pick cut sheet media from two separate trays or locations. Furthermore, the invention feeds cut sheet media from two separate trays or locations to the same feed path to be taken by the pinch rollers 90 and 92. These advantages are facilitated by the use of the sidekicks 66 and 68, which are made of flexible material capable of flexing and not obstructing automatic feed sheet media from being delivered by the same sheet media pick mechanism to the same feed path in the absence of manual feed sheet media. These advantages allow a simple mechanism for feeding sheet media from two separate locations to be produced at substantially reduced costs, since the cost of producing the two flexible sidekicks 66 and 68 is extremely low. As a result, it is also inexpensive to replace damaged sidekicks.

While the invention has been shown and described with reference to a preferred embodiment thereof, it will be appreciated by those having skill in the art that variations in form and detail may be made therein without departing from the spirit and scope of the invention.

What is claimed is:

1. An apparatus for holding sheet media comprising:

lower holding means for holding a stack of sheet media, the lower holding means having means for restraining a sheet of sheet media from the sheet media stack;

upper holding means for holding sheet media, the upper holding means being positioned above the lower holding means and exposing a portion of the lower holding means; and flexible means for supporting sheet media in the upper holding means, the flexible means having means for restraining a sheet of sheet media, the flexible means further extending over the length of an exposed portion of the lower holding means and adapted to be flexed upwards upon a sheet of sheet media being picked from the lower holding means when sheet media is absent from the upper holding means and while the flexible means extend over the length of the exposed portion of the lower holding means.

2. An apparatus as recited in claim 1, wherein the upper holding means further comprises means for guiding sheet media, the guide means capable of being slidably adjusted for accommodating varying widths of sheet media.

3. A sheet media tray comprising:

a lower tray having a plurality of sheet media restrainers; and an upper tray having a frame positioned over the rear portion of the lower tray and leaving a front portion of the lower tray exposed, the upper tray further comprising two flexible sidekicks extending out over the length of the exposed front portion of the lower tray, each sidekick having a restrainer at its front tip thereat, each sidekick further adapted to be flexed upwards upon a sheet of sheet media being picked from the lower tray and while the sidekicks extend over the length of the exposed portion of the lower tray.

4. A sheet media tray as recited in claim 3, wherein the upper tray further comprises a left sheet media guide disposed on the left side of the frame and a right sheet media guide disposed on the right side of the frame.

5. A sheet media tray as recited in claim 4, wherein the sheet media guides may be slidably adjusted for accommodating varying widths of sheet media.

6. A sheet media tray as recited in claim 3, wherein the restrainer in the upper tray is hook-shaped.

7. A sheet media tray, comprising:

a lower tray having a bottom plate, a front wall, a rear wall, a left side wall and a right side wall, and including at least one sheet media restrainer adjacent the front wall; and an upper tray having a frame positioned over a rear portion of the lower tray and leaving a front portion adjacent the front wall of the lower tray exposed, including a left sheet media guide disposed on the left side of the frame and right sheet media guide disposed on the right side of the frame, each sheet media guide having a flexible sidekick secured to it and extending out over the length of the exposed portion of the lower tray, each sidekick having a sheet media restrainer at its front tip thereat, each sidekick adapted to be flexed upwards upon a sheet of sheet media being picked from the lower tray when sheet media is absent from the upper tray.

8. A sheet media tray as recited in claim 7, further comprising left and right sheet media guides wherein the left sheet media guide and the right sheet media guide of the upper tray may be slidably adjusted for accommodating varying widths of sheet media.

9. A sheet media tray as recited in claim 7, wherein the lower tray further comprises a support plate mounted on the bottom plate by an elevating mechanism.

10. A sheet media tray as recited in claim 9, wherein the support plate maintains the stack of sheet media in the lower tray at a vertical level not exceeding the level of the sheet media restrainer.

11. A sheet media feed mechanism comprising:

lower holding means for holding a stack of sheet media, the lower holding means having means for restraining a sheet of sheet media from the sheet media stack;

upper holding means for holding sheet media, the upper holding means being positioned above the lower holding means and having flexible means for supporting sheet media, the flexible support means extending over the length of an exposed portion of the lower holding means and having means for restraining a sheet of sheet media; and means for picking one sheet of sheet media, the picking means adapted to pick one sheet of sheet media from the upper holding means when at least one sheet of sheet media is present thereat, the flexible support means adapted to be flexed upwards upon the picking of one sheet of sheet media from the lower holding means when sheet media is absent from the upper holding means and while the flexible support means extend over the length of the exposed portion of the lower holding means.

12. A sheet media feed mechanism as recited in claim 11, wherein the flexible support means is capable of assuming a first position in which the flexible support means is aligned substantially parallel to the horizontal plane, and assuming a second position when sheet media is absent from the upper holding means wherein the flexible support means experiences a vertical displacement caused by a sheet of sheet media being picked from the lower holding means by the picking means.

13. A sheet media feed mechanism as recited in claim 11, wherein the picking means comprises a shaft having at least one roller.

14. A sheet media feed mechanism, comprising:

a feed path for receiving a sheet of sheet media to be printed;

a sheet media tray including a lower tray having at least one sheet media restrainer adjacent the feed path, and an upper tray having a frame positioned over a rear portion of the lower tray and leaving a front portion of the lower tray adjacent the feed path exposed, the upper tray further having a plurality of flexible sidekicks extending out over the length of the exposed portion of the lower tray, each sidekick having a sheet media restrainer at its front tip thereat; and means for picking a sheet of sheet media from the sheet media ray, the picking means adapted to pick the top sheet of sheet media from the upper tray if sheet media is present thereat, and further adapted to pick the top sheet of sheet media from the lower tray when sheet media is absent form the upper tray, each sidekick adapted to be flexed upwards upon a sheet of sheet media being picked from the lower tray when sheet media is absent from the upper tray.

15. A sheet media feed mechanism as recited in claim 14, wherein the upper tray further comprises a left sheet media guide disposed on the left side of the frame and a right sheet media guide disposed on the right side of the frame.

16. A sheet media feed mechanism as recited in claim 14, wherein the picking means comprises a shaft having at least one roller.

17. A sheet media feed mechanism as recited in claim 16, wherein the roller is a D-shaped roller.

18. A sheet media feed mechanism as recited in claim 14, wherein the flexible sidekicks are capable of assuming a first position in which the flexible sidekicks are aligned substantially parallel to the horizontal plane, and assuming a second position when sheet media is absent from the upper tray wherein the flexible sidekicks experience a vertical displacement caused by a sheet of sheet media being picked from the lower tray by the picking means.

19. A sheet media feed mechanism as recited in claim 14, wherein the lower tray further comprises a support plate and an elevating mechanism.

20. A sheet media feed mechanism as recited in claim 19, wherein the support plate maintains the stack of sheet media in the lower tray at a vertical level not exceeding the level of the sheet media restrainer.

21. A sheet media tray, comprising:

a lower tray having a bottom plate, a front wall, a rear wall, a left side wall and a right side wall, and including at least one sheet media restrainer adjacent the front wall; and an upper tray having a frame positioned over a rear portion of the lower tray and leaving a front portion adjacent the front wall of the lower tray exposed, including a left sheet media guide disposed on the left side of the frame and a right sheet media guide disposed on the right side of the frame, each sheet media guide having a flexible sidekick secured to it and extending out over the length of the exposed portion of the lower tray, each sidekick having a hook-shaped sheet media restrainer at its front tip thereat.

22. A sheet media feed mechanism, comprising:

a feed path for receiving a sheet of sheet media to be printed;

a sheet media tray including a lower tray having at least one sheet media restrainer adjacent the feed path, and an upper tray having a frame positioned over a rear portion of the lower tray and leaving a front portion of the lower tray adjacent the feed path exposed, the upper tray further having a plurality of flexible sidekicks extending out over the length of the exposed portion of the lower tray, each sidekick having a hook-shaped sheet media restrainer at its front tip thereat; and means for picking a sheet of sheet media from the sheet media tray, the picking means adapted to pick the top sheet of sheet media from the upper tray if sheet media is present thereat, and further adapted to pick the top sheet of sheet media from the lower tray when sheet media is absent from the upper tray.

* * * * *